US007335050B2

(12) United States Patent
Kirk et al.

(10) Patent No.: US 7,335,050 B2
(45) Date of Patent: Feb. 26, 2008

(54) ELECTRICAL CONNECTOR FOR USE IN CONNECTING WIRES

(75) Inventors: Douglas L Kirk, Ballwin, MO (US); Thomas A King, Chesterfield, MO (US)

(73) Assignee: Blazing Products, Inc., Chesterfield, MO (US)

( * ) Notice: Subject to any disclaimer, the term of this patent is extended or adjusted under 35 U.S.C. 154(b) by 0 days.

(21) Appl. No.: 11/173,786

(22) Filed: Jul. 1, 2005

(65) Prior Publication Data

US 2007/0004269 A1 Jan. 4, 2007

(51) Int. Cl.
*H01R 11/20* (2006.01)

(52) U.S. Cl. ..... 439/410; 439/790

(58) Field of Classification Search ..... 439/409, 439/410, 521, 789, 790, 936
See application file for complete search history.

(56) References Cited

U.S. PATENT DOCUMENTS

| | | | | |
|---|---|---|---|---|
| 3,124,409 | A | 3/1964 | Nisula | |
| 3,675,182 | A | 7/1972 | Gregory | |
| 3,836,941 | A | 9/1974 | Izraeli | |
| 3,936,128 | A | 2/1976 | D'Annessa et al. | |
| 3,973,822 | A | 8/1976 | Sugimoto | |
| 3,990,129 | A * | 11/1976 | Cornell et al. | 24/132 R |
| 4,014,078 | A * | 3/1977 | Cornell et al. | 24/132 R |
| 4,077,697 | A | 3/1978 | Yates | |
| 4,103,984 | A | 8/1978 | Mixon, Jr. | |
| 4,103,986 | A | 8/1978 | Izraeli | |
| 4,269,465 | A | 5/1981 | Mueller | |
| 4,277,124 | A | 7/1981 | Loose et al. | |
| 4,437,723 | A | 3/1984 | Narozny | |
| 4,444,447 | A | 4/1984 | Markwardt | |
| 4,548,462 | A * | 10/1985 | Cornell | 439/789 |
| 4,564,256 | A | 1/1986 | Damiano et al. | |
| 4,653,831 | A | 3/1987 | Wilson et al. | |
| 4,842,546 | A | 6/1989 | Song | |
| 4,995,827 | A | 2/1991 | Rudoy | |
| 5,030,136 | A | 7/1991 | Reinhardt et al. | |
| 5,254,015 | A * | 10/1993 | Robertson | 439/410 |
| 5,470,250 | A * | 11/1995 | Hawk et al. | 439/409 |
| 5,765,962 | A * | 6/1998 | Cornell et al. | 403/396 |
| 6,120,334 | A | 9/2000 | Timsit et al. | |
| 6,135,804 | A | 10/2000 | Lux | |

(Continued)

FOREIGN PATENT DOCUMENTS

| | | |
|---|---|---|
| CH | 567 338 | 9/1975 |

(Continued)

OTHER PUBLICATIONS

ExxonMobil Chemical, "Butyl Polymers", 2002; may be seen at www.exxonmobilchemical.com/Public_Products/Butyl_Polymers/Worldwide.

*Primary Examiner*—Thanh-Tam Le
(74) *Attorney, Agent, or Firm*—Harness, Dickey & Pierce, P.L.C.

(57) ABSTRACT

An electrical connector having a housing with a chamber and at least one wire receiving passageway for receiving two or more wires into the chamber. An engagement member is configured to be rotatable within the chamber. The engagement member is configured to fracture a portion of any insulating covering on each wire and complete electrical contact between the conductors of the two or more wires upon rotation of the engagement member.

38 Claims, 3 Drawing Sheets

U.S. PATENT DOCUMENTS

| | | | | |
|---|---|---|---|---|
| 6,241,563 | B1 * | 6/2001 | Warner et al. | 439/789 |
| 6,250,948 | B1 * | 6/2001 | Daoud | 439/409 |

FOREIGN PATENT DOCUMENTS

| | | |
|---|---|---|
| DE | 39 42 520 | 6/1991 |
| EP | 1492199 | 12/2004 |
| FR | 2254133 | 7/1975 |
| WO | 01 91239 | 11/2001 |

* cited by examiner

ELECTRICAL CONNECTOR FOR USE IN CONNECTING WIRES

FIELD OF THE INVENTION

The present invention relates to a connector, and more specifically to an electrical connector.

BACKGROUND OF THE INVENTION

In recent years, there has been a continual increase in the use of electrical equipment in various industries, and the need for connecting various components of the equipment or systems containing disparate electrical components. By way of example, both lawn sprinkler systems and landscape lighting systems include a plurality of electrical components that must be electrically connected.

In these situations, it is common practice to electrically connect wires by means of an electrical connector. Some connectors require that the wires to be connected be stripped of their insulated covering to expose the electrical conductor prior to insertion of the wire into the connector. However, in practice it is very desirable to connect wires without first having to remove the insulation on the wire. To address this, connectors have been designed that include one or more pins for penetrating the insulation and contacting the conductor. In practice the pins are often bent or only make partial or poor electrical contact with the electrical conductor within the wire. Additionally, these types of connectors are susceptible to the impacts of the operating environment that includes stress, strain, and corrosion.

In other designs, the electrical connectors have included a slot for receiving the insulated wire. The slots are configured and dimensioned with sharp edges to cut into the insulation and electrically contact the conductor within the wire upon insertion of the insulated wire into the slot. A plurality of wires can be electrically connected by electrically connecting the pins or the slots to complete the electrical circuit between two or more wires that have been penetrated by the pins, or received and cut by the slots. However, in practice an operator does not insert the wire far enough into the slot to provide more than a partial electrical connection. Additionally, these connectors either do not make sufficient electrical contact, or cut into the conductor thereby creating a potential point of failure. Such failures can include heating, corrosion, and/or failure of the conductor within the wire.

It is also common practice to provide strain relief to the wires during or after the electrical contact has been made. The strain relief provides that when a tensile force is applied to the wire, the force is transmitted through the insulation or other portion of the wire, rather than the conductor or at the place of electrical connectivity. As such, the strain relief provides both a stress bypass and a protection for the electrical connection against damage. Generally, in the pin penetrating connectors, the connector is mounted externally to the insulation and only minimal strain relief to the connector and the inserted pins can be provided by a clamping arrangement of the connector around the wire. Similar slot connectors cannot easily provide for coupling to the wire insulation as the connector slot sides cut into the insulation thereby providing a point of failure to the insulation, rather than strain relief.

Such electrical connections are often placed in an operating environment that is hazardous or that can include hazardous elements or situations. Water or moisture infiltration into the electrical connection can cause electrical shorting, rust buildup, a deterioration of the electrical connection, the generation of heat or hot spots, and can result in ruined electrical equipment. Keeping the outdoor electrical connections watertight, however, can be difficult. Penetrating pin connectors typically only partially enclose the wire and clamp to the external surface of the insulation of the wire. Slot connectors cut into the sides of the insulation and do not provide a water-tight seal between the slots on the conductor or about the location of the slot, the cut, or the conductor within the wire.

SUMMARY OF THE INVENTION

As such, the inventor of the present invention has succeeded in designing an electrical connector that provides for electrically connecting a plurality of conductors with a simple rotation of a portion of the connector. The ends of the wires may include an electrical insulation or can be stripped to expose the conductor therein. The electrical connector herein can provide for strain relief by also coupling, at least in part, to the insulation portion of the wire when the user is making the electrical connection. The electrical connector can also provide for a waterproof or moisture resistant electrical connection between the wire conductors.

According to one aspect of the invention, an electrical connector includes a housing having a chamber and at least one wire receiving passageway for receiving two or more wires into the chamber. An engagement member is configured to be rotatable within the chamber, to fracture a portion of any insulating covering on each wire and to complete electrical contact between the conductors of the two or more wires upon rotation of the engagement member.

According to another aspect of the invention, an electrical connector includes a housing having a chamber and at least one wire receiving passageway for receiving two or more wires into the chamber. A cover is configured for rotatable coupling to the housing and at least partially enclosing the chamber. A conductive engagement member is coupled to the cover and is rotatable within the chamber upon rotation of the cover. The conductive member includes a fracturing portion that is configured to fracture a portion of any insulated covering on each wire and complete an electrical contact between the conductors of the two or more wires upon rotation of the cover.

According to yet another aspect of the invention, an electrical connector includes a housing having a chamber and a plurality of wire receiving passageways for receiving two or more wires into the chamber. A conductive engagement member is configured to be rotatable within the chamber and includes a plurality of engagement member wire receiving passageways for receiving ends of the two or more wires. The conductive engagement member includes a fracturing portion configured to fracture a portion of any insulated covering on each wire and complete an electrical contact between the conductors of the two or more wires with a rotation of the conductive engagement member within the housing.

According to still another aspect of the invention, an electrical connector includes a housing having a chamber and at least one wire receiving passageway for receiving two or more wires into the chamber. An engagement member is rotatable within the chamber and has a plurality of engagement member wire receiving passageways for receiving the two or more wires received into the chamber of the housing. A conductive member is configured for contacting each of the conductors to complete electrical contact between the conductors of the two or more wires. The conductive member includes a cutting portion configured to fracture a portion of any insulated covering on each wire upon rotation of the engagement member. The engagement member is configured to urge each wire into contact with the cutting portion of the conductive member upon rotation of the engagement member.

Further aspects of the present invention will be in part apparent and in part pointed out below. It should be understood that various aspects of the invention may be implemented individually or in combination with one another. It should also be understood that the detailed description and drawings, while indicating certain exemplary embodiments of the invention, are intended for purposes of illustration only and should not be construed as limiting the scope of the invention.

BRIEF DESCRIPTION OF THE DRAWINGS

Like reference symbols indicate like elements or features throughout the drawings.

DETAILED DESCRIPTION OF EXEMPLARY EMBODIMENTS

The following description is merely exemplary in nature and is not intended to limit the invention, its applications, or uses.

In various embodiments of the invention, an electrical connector includes a housing having a chamber and one or more wire receiving passageways. Each wire receiving passageway can be configured to receive one or more wires into the chamber. An engagement member is configured to be rotatable within the chamber. The engagement member and the chamber are configured to fracture a portion of any insulating covering on each wire and complete electrical contact between the conductors of the two or more wires upon rotation of the engagement member. Fracturing as used herein is intended to include by way of example, but not be limited to, breaking, removing, rupturing, cutting, stripping, and/or slicing. In order to better appreciate the various features and embodiments, several exemplary embodiments of an electrical connector will now be described, some with reference to the above described figures.

In one exemplary embodiment of the invention, an electrical connector includes a housing having a chamber and at least one wire receiving passageway for receiving two or more wires into the chamber. An engagement member is rotatable within the chamber and has a plurality of engagement member wire receiving passageways for receiving the two or more wires received into the chamber of the housing. A conductive member is configured for contacting each of the conductors to complete electrical contact between the conductors of the two or more wires. The conductive member includes a cutting portion configured to fracture a portion of any insulated covering on each wire upon rotation of the engagement member. The engagement member is configured to urge each wire into contact with the cutting portion of the conductive member upon rotation of the engagement member.

Figure 1:
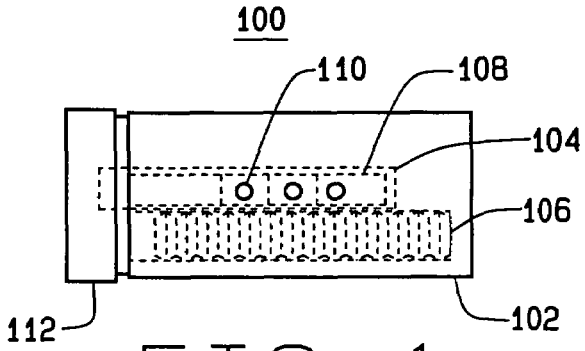
FIG. 1 is a top view of a connector according to a first exemplary embodiment of the invention.
Figure 2:
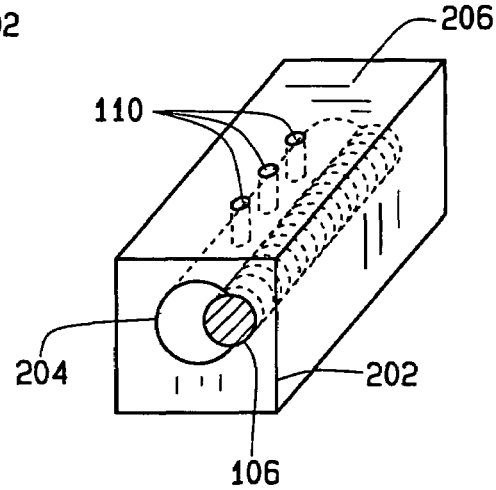
FIG. 2 is a perspective view of a housing and conductive member according to one implementation of the first exemplary embodiment of FIG. 1.
Figure 3:
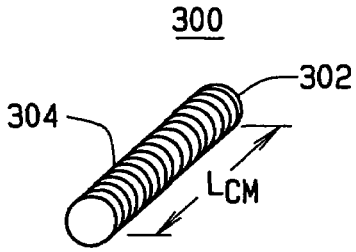
FIG. 3 is a perspective view of a conductive member according to one implementation of the first exemplary embodiment of FIG. 1.

One such implementation is illustrated in the top plan view on an electrical connector 100 in FIG. 1. The electrical connector 100 has a housing 102 that defines a chamber 104. A conductive member 106 is position within the housing 102 such that at least a portion of the conductive member 106 is exposed or within the chamber 104. The conductive member 106 can be composed of a metal or a electrically conductive ceramic or other conductive material. In some embodiments, it may be composed of a non-electrically conducting material such as plastic and have one or more conductive portions, such as metallic or ceramic pieces. The conductive member 106 can also be of any shape. FIG. 2 illustrates an end perspective view of a housing 202 having, as an example, the placement of the conductive member 106 partially within the circular chamber 204. As shown in FIG. 2, the wire receiving passageways 110 extend from an exterior portion or surface 206 of housing 202 and into the chamber 204. FIG. 3 illustrates an example of a conductive member 300. In this example, the conductive member 300 has a conductive member body 302 with a plurality of threads 304 that extend, at least partially, along the length $L_{cm}$ of the conductive member body 302. The threads 304 can be entirely around the circumference or exterior surface of the conductive member body 302 as shown, or can be around only a portion thereof. The threads 304 can include sharp thread peaks (not shown) that can be configured for fracturing the coating or insulation of a wire down to, but not including, a substantial portion of the conductor within the wire.

Referring back to FIG. 1, an engagement member 108 is positioned and rotatable within the chamber 104. One or more wire receiving passageways 110 provide for receiving one or more ends of wires (not shown) to be electrically coupled by the connector 100. The wire receiving passageways 110 provide for receiving the wire ends through the housing 102 and into the chamber 104. The wire receiving passageways 110 can also be provided within the engagement member 108 such that the wire ends inserted into a wire receiving passageway pass through the housing 102 into the chamber 104 and at least partially through the engagement member 108. In some embodiments, a user rotational element 112 such as a handle can be attached to the engagement member 108 to enable a user to rotate the rotational element 112 and thereby rotate the engagement member 108 within the chamber 104 relative to the housing 102 and to the conductive member 106. In other embodiments, the user rotational element can be a knob, a screw head, a notch, a tab, an Allen head, or threads.

The engagement member 108, the chamber 104 and the conductive member 106 are dimensioned and positioned such that the wires within the wire receiving passageways are rotated during the rotation of the engagement member 108 and are fractured by urging the wires against the conductive member 106. Upon fracturing, a conductor within the wire is electrically contacted by the conductive member 106. In some embodiments, a plurality of wires can be inserted in each or more than one wire receiving passageway 110. As each wire is fractured by the conductive member 106 during the rotation of the engagement member 108 and contacted by the conductive member 106, electrical contact is provided by electrical connector 100 through the conductive member 106 and between each of the wires.

Figure 4:
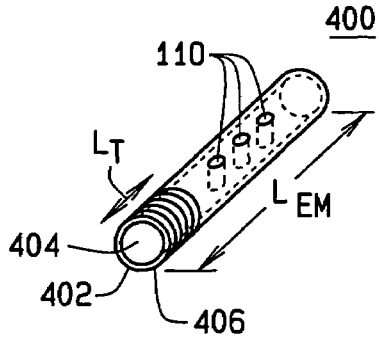
FIG. 4 is a perspective view of an engagement member according to one implementation of the first exemplary embodiment as shown in FIG. 1.

Shown in FIG. 4 is a perspective view of an example of an engagement member 400 for the electrical connector 100. The engagement member 400 has an engagement member body 402 that can be a cylinder having an inner chamber 404, or can be solid (not shown). The engagement member body 402 has a length $L_{em}$ that can include threads 406 on a portion or length $L_t$. The threads 406 can provide for the attachment of the rotational element 112 (shown in FIG. 1 and FIG. 5). Other members can also be utilized for attaching the rotational element 112 to the engagement member body 402. One or more wire receiving passageways 110 can extend through the engagement member body 402 or only extend partially into the engagement member body 402. Each wire receiving passageway 110 is configured to receive at least one wire end to be electrically connected. The wire can be fractured, such as by breaking, rupturing, cutting, stripping or slicing, by way of example, such that a portion or all of any insulated material protecting and/or insulating one or more conductors within the wire is removed or rearranged.

Figure 5:
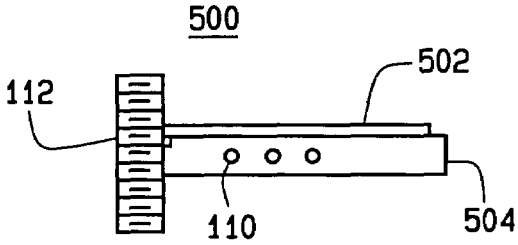
FIG. 5 is a perspective view of an engagement member having a handle and a wiper blade according to a second implementation of the first exemplary embodiment as shown in FIG. 1.

FIG. 5 illustrates another engagement member 500 that includes a rotational element 112 and a wiper blade 502. In this embodiment, the engagement member body 504 includes a plurality of wire receiving passageways 110 along the length of the body 504. The rotational element 112 is attached to one end of body 504 to enable a user to rotate the engagement member body 504. The wiper blade 502 is positioned along the length of the body 504 and extends radially from the body 504. The wiper blade 502 can be made of a material such as rubber or plastic, by way of example, or may be made of a metal or composite material. The wiper blade 502 is configured relative to the engagement member body 504 such that when the engagement member body 504 is placed within the chamber such as chamber 104 or 204, the wiper blade 502 rotates with the engagement member 108 and extends into the chamber 104 to spread any material or filling matter located within the chamber 104. For example, the chamber 104 can be filled, or partially filled, with a waterproofing material such as a moisture resistant encapsulant.

Figure 6A:
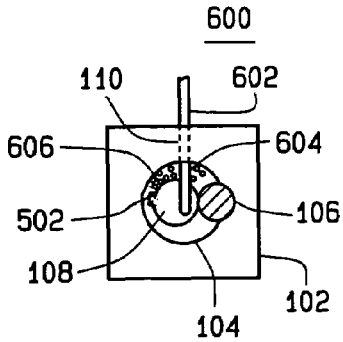
FIGS. 6A and 6B are end views of one implementation of the first exemplary embodiment of FIG. 1 illustrating the before and after coupling of a wire.

In operation, as shown by way of example in FIG. 6A, one or more wires 602 includes wire ends 604 that are inserted and received by wire receiving passageways 110 within housing 102 and into chamber 104. The wire ends 604 are also received by the wire receiving passageways 110 of the engagement member 108. A sealing material 606, such as a moisture resistant encapsulant or gel, can be positioned within the chamber 104 and about engagement member 108. The sealing material 606 can be a viscous or non-viscous material and can include a hardening or non-hardening epoxy or potting compound.

Figure 6B:
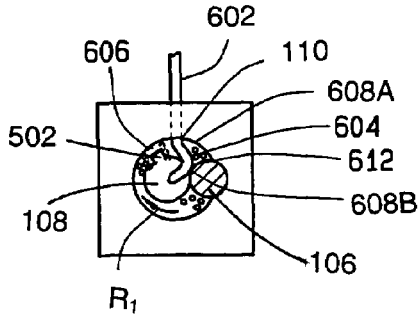

FIGS. 6A and 6B illustrates the operation and position of the various components following rotation of the engagement member 108 relative to the housing 102 by a user. As shown, the engagement member 108 has been rotated in a clockwise direction, in this example, as shown by arrow $R_1$. In this case the rotation $R_1$ can be less than a quarter turn or 90 degrees. However, in other embodiments, the rotation can be less than 60 degrees and in other embodiments a one-half or three-quarter turn can be utilized and still be within the scope of the invention. Upon rotation of the engagement member 108, the engagement member 108 pulls the wire ends 604 within the chamber 104 in the direction of the rotation arrow $R_1$ and into contact with the conductive member 106. The engagement member 108, the chamber 104, and the conductive member 106 are configured such that at least a portion of the wires are engaged, biased under pressure, or urged into contact with the conductive member 106 whereby the engagement member 108 is configured so that the conductive member 106 fractures or cuts into any insulated covering or insulation of the wire surrounding the wire conductor. As noted above, the conductive member 106 can include one or more sharp portions, such as threads, that are configured to cut or fracture at least a portion of the insulating coating of any wire urged against the sharp portion. Upon fracturing the insulation of the wire 602, the conductive member 106 makes electrical contact at contact point 612 with the conductor within the wire 602.

As shown in FIGS. 6A and 6B, the connector 600 and its components can be configured to induce one or more directional changes (angular changes) in the wire 602. In one embodiment, at least one directional change 608A and 608B in the wire 602 is imparted during the rotation of the engagement member 108. In another embodiment, two directional changes in the wire 602 are imparted during the rotation. These are illustrated as 608A and 608B in FIG. 6B. Also as illustrated, when the chamber 104 includes a sealing material 606, such as a moisture resistant encapsulant, the rotation of the engagement member 108 can provide for distributing or dispersing at least a portion of the sealing material 606 within the chamber 104 and about the wires ends 604 and possibly about wire receiving passageways 110. In such a manner, the sealing material 606 can at least partially prevent the ingress of moisture into the chamber 104, about the wire ends 604, and/or about the contact point 612. This process can be supported or enhanced by the inclusion of the wiper blade 502.

Referring again to FIGS. 6A and 6B, the housing 102, the chamber 104 and the wire receiving passageways 110 can be configured to receive a plurality of wires. In one exemplary embodiment, each wire receiving passageway 110 is dimensioned to receive a single insulated wire 602. Upon rotation of the engagement member 108 by a user, each wire 602 is fixedly engaged by the engagement member 108 and urged against the conductive member 106 for fracturing and contacting. Additionally, each wire 602 is imparted with at least one directional change and is held in place within the wire receiving passageways 110. The housing 102 and wire receiving passageways 110 can be dimensioned to provide for frictionally engaging the wire 602 and in particular the insulated covering to the wire 602 to provide a strain or stress relief to the wire and to the connection.

Where a sealing material 606 is provided within chamber 104, the sealing material 606 can be any type of material such as a viscous or non-viscous material, epoxy, silicone, or polymer, by way of example. In one embodiment, the sealing material 606 is Vistanex Polyisobutylene, available from Exxon Mobile Corporation or BASF Corporation, or a similar type of moisture resistant and sealing hydrocarbon polymer from other manufacturers.

It should be noted, that in some embodiments, one or more of the features or elements can be combined and still be within the scope of the invention. By way of example, while the above description has described the conductive member 106 and the engagement member 108 as two separate components, as will be discussed below, a single component or member can provide for the engagement, the fracturing, and the conductivity. Additionally, one or more components can be implemented in plurality even though not described above. For instance, there may be two or more conductive members 106 that would provide for making or contacting two or more different electrical connections by the rotation of a single engagement member 108.

Additionally, while not shown in FIGS. 1-6, the engagement member 108 and/or the user rotational element 112, or another feature or element can be provided to prevent or restrict the rotation of the engagement member 108. In particular, such a feature can restrict or prevent the rotation in the opposite direction from that imparted by the user to fracture and electrically couple the wires. Various locks, latches, gears, clips and other retainer devices are known to those skilled in the art to prevent a non-desired non-engaging rotation without user interaction.

In another exemplary embodiment of the invention, an electrical connector includes a housing having a chamber and a plurality of wire receiving passageways for receiving two or more wires into the chamber. A conductive engagement member is configured to be rotatable within the chamber and includes a plurality of engagement member wire receiving passageways for receiving ends of the two or more wires. The conductive engagement member includes a fracturing portion configured to fracture a portion of any insulated covering on each wire and complete an electrical contact between the conductors of the two or more wires with a rotation of the conductive engagement member within the housing.

Figure 7:
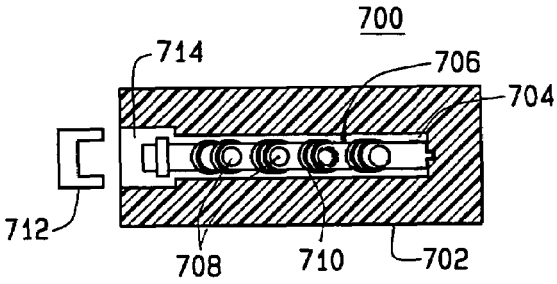
FIG. 7 is a cutaway view of a connector according to a second exemplary embodiment of the invention.
Figure 8:
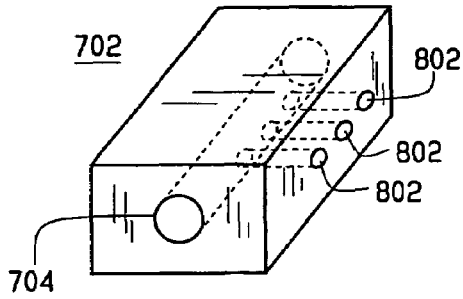
FIG. 8 is a perspective view of a housing according to one implementation of the second exemplary embodiment of FIG. 7.

One implementation of such an embodiment is shown in the cutaway views of FIGS. 7 and 8. A connector 700 has a housing 702 that defines a chamber 704. An engagement member 706 is configured and dimensioned for insertion and rotation within the chamber 704. In some embodiments, the engagement member 706 can be composed of a metal or a ceramic or other electrically conductive material. In some embodiments, it may be composed of a non-electrically conducting material such as plastic and have one or more conductive portions, such as metallic or ceramic pieces. The engagement member 706 can also be of any shape. The engagement member 706 includes one or more wire receiving passageways 708 that are configured to receive an end of one or more wires to be electrically connected by the connector 700. One or more fracturing members 710 can be included on the engagement member 706 to aid in the fracturing of any insulation that may be covering the conductive member within the wire. As shown in this example, the connector can also include a cap or cover 712 for sealing the chamber 704. The cover 712 can be adapted for insertion in or engage to a receiving portion 714 of chamber 704. Additionally, the housing 702 can define a receiving chamber or feature for receiving and/or locking the cover 712 onto the housing 702 as shown in FIG. 7. As illustrated in FIG. 8, the housing 702 can include one or more wire receiving passageways 802 that extend from an external surface or portion of the housing 702 into the chamber 704. Each of the housing wire receiving passageways 802 are dimensioned to receive one or more wires to be coupled by the connector 700. While the housing 702 is illustrated in FIG. 8 as being a rectangle, the housing 702 can have any shape as it is only illustrated here, by way of example.

Figure 9:
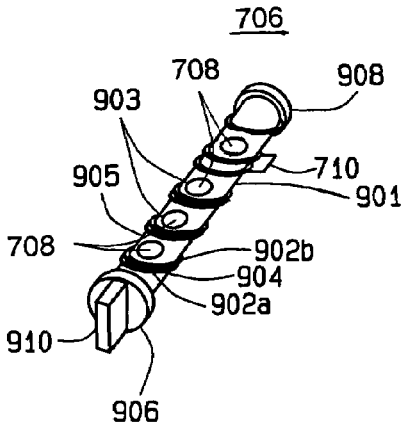
FIG. 9 is a perspective view of a conductive member according to one implementation of the second exemplary embodiment of FIG. 7.

FIG. 9 illustrates one exemplary embodiment of an engagement member 706 that can be utilized in the connector 700. The engagement member 706 includes engagement member body 901 that can be cylindrical as shown, but that can be any shape that can be rotated by a user within the chamber 704 and provide for the fracturing and electrical coupling by the engagement member 706. To aid in the fracturing of the insulation covering of a wire inserted into one of the wire receiving passageways 708, the engagement member body 901 can include a flat or flattened portion 903 that defines a sharp edge 905 along the outer perimeter of the engagement member body 901. The sharp edge 905 can be configured to fracture, cut and/or strip a portion of the insulation covering the conductor of a wire inserted into wire receiving passageways 708. In other embodiments, the one or more fracturing members 710 can be on the outer surface of the engagement member body 901. As illustrated, the fracturing member 710 can be in the form of threads or similar features having one or more sharp peaks 902A and 902B and one or more valleys 904. These fracturing members 710 can be along the radial portion or the flat portion 903 of the engagement member body 901 and can be configured at an angle, as shown, such that a wire placed within one of the wire receiving passageways, engages one of the fracturing members 710 upon rotation of the engagement member 706.

As noted in FIG. 9, the engagement member body 901 can be a cylinder having a first end 906 and a second end 908. The first end 906 can be configured to include a user rotational element 910, such as described above with regard to user rotational element 112 in FIG. 1. As shown in FIG. 9, the user rotational element 910 can be a tab or any other similar element capable of receiving and imparting a rotation force to the engagement member body 901. The engagement member body 901 can be made of an electrically conducting material or have electrically conductive portions. Additionally, in some embodiments the engagement member body 901 can include electrically conductive segments (not shown) each having one or more wire receiving passageways 708. In this manner, each conductive segment of the engagement member 706 can electrically couple separate electrical circuits thereby enabling the connector 700 to complete the electrical coupling of multiple separate electrical connections.

Figure 10A:
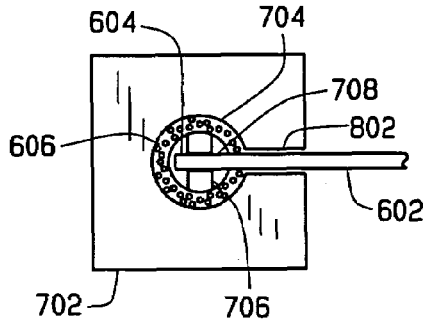
FIGS. 10A and 10B are end views of one implementation of the second exemplary embodiment of FIG. 7 illustrating the before and after coupling of a wire.
Figure 10B:
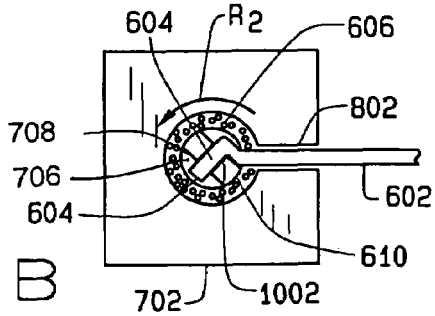

One exemplary operation of some embodiments of the connector 700 is illustrated in FIGS. 10A and 10B that provide two cross-sectional views of the operation of the wire connector 700 having wires inserted before and after rotation of the engagement member 706. As illustrated, the connector 700 includes the housing 702 with the chamber 704 and the wire receiving passageways 802. The engagement member 706, such as illustrated in FIG. 9, by way of example, is positioned within the chamber 704. A sealing material 606 is within the chamber 704 and about the engagement member 706. A wiper blade (not shown) could also be positioned on the engagement member 706 or within the chamber 704 to aid in retaining and/or distributing the sealing fluid within the chamber 704.

In operation, as shown in FIG. 10A one or more wires 602 are inserted into the wire receiving passageway(s) 802 of housing 702. As illustrated, each wire 602 includes the wire end 604 that can include an insulated covering over the electrical conductor of the wires 602, e.g., the wire end 604 does not require stripping by the user. However, the connector 700 will also receive and couple wire ends 604 that have been stripped of their insulated covering. The wire conductor within the wire 602 can be a solid core conductor or a stranded conductor. The wire end 604 is inserted through the housing wire receiving passageways 802, into the chamber 704, and into and through, at least a portion of, the wire receiving passageway 708 of the engagement member 706. The wire end 604 can be inserted by the user until the user feels or determines that the insertion of the wire end 604 has stopped or reached an end or stop point of the wire receiving passageways 802 and 708 and/or the chamber 704. The wire receiving passageways 802 and 708, the engagement member 706, the housing 702 and the chamber 704 are dimensioned and configured to receive the wire 602 and wire end 604 and can be sized differently or adapted in various embodiments to various diameter, sizes and types of wire 602, the insulation portion of the wire, and/or the conductor within the wire, to provide for fracturing and contacting during the rotational operation of the engagement member 706.

After the wire end 604 or ends in the case of multiple inserted wires 602, the user rotates the engagement member 706 by rotating a user rotational element or feature. This can include a handle, a knob, a screw head, thread, notch, tab, or an Allen head associated with or attached to the engagement member 706. In the example of FIG. 10B, the engagement member is rotated in a counterclockwise direction as indicated by the rotation arrow $R_2$. In other embodiments, the rotation may be in a clockwise direction. The rotation can be any amount of rotation between 30 and 360 degrees. In various embodiments, the rotation is about 60 degrees, 75 degrees, 90 degrees, 135 degrees, and 180 degrees. In the example of FIGS. 10A and 10B, the rotation is less than or equal to 90 degrees.

During rotation, the engagement member 706 couples the wire end 604 and pulls the wire end 604 in the direction of the rotation. The wire 602 is rotated around the circumference of the engagement member 706 and frictionally coupled between the engagement member 706 and the interior surfaces of the chamber 704. The engagement member 706 and the chamber 704 are configured to impart one or more directional changes to the wire 602 during the rotation of the engagement member 706. In one embodiment, the wire 602 is forced to make at least one directional change during rotation. In another embodiment, the wire 602 is forced to make at least two directional changes during rotation.

The wire 602 being coupled within the wire receiving passageways 708 of the engagement member 706, are frictionally engaged with the sharp edge 905 and/or the fracturing member 710 of the engagement member 706 during the rotation. The sharp edge 905 and the fracturing member 710 along with the frictional coupling between the engagement member 706 and the interior surfaces of the chamber 704 provide for a fracturing of any insulated covering of the wire 602 and an exposing of a conductor therein. In one embodiment, the sharp edge 905 provides a fracturing, cutting and/or stripping of a portion of the insulated covering that exposes the conductor within the wire. As the engagement member 706 with the sharp edge 905 fracture, cut and/or strip the insulated covering, a portion of the engagement member 706 also makes electrical contact at a contact point 1002 with the conductor within the wire 602. The engagement member 706 being made of an electrically conducting material provides for the electrical coupling of the conductor. In this manner, where two or more wires 602 have been inserted into the connector 700 in one or more of the wire receiving passageways 802 and 708, the engagement member 706 completes an electrical connection between the two or more wires 602.

During the rotation of the engagement member 706, the sealing material 606 is distributed or spread, at least in part, around the engagement member 706 and through the chamber 704. The chamber 704 and the engagement member 706 are configured to distribute the sealing material 606 around the wires 602, the wire ends 604, the wire receiving passageways 802, and the contact point 1002 between the engagement member 706 and the conductor and/or fractured portion of the wire. While not shown in FIG. 10B, one or more wiper blades, or protruding portions of the engagement member 706 and/or the chamber 704 can also provide for distribution of the sealing material 606 during and following rotation of the engagement member 706. Additionally, as discussed above, one or more locking mechanisms or members can be utilized to lock or retain the engagement member 706 into the rotated position as shown in FIG. 10B.

In another exemplary embodiment of the invention, an electrical connector includes a housing having a chamber and at least one wire receiving passageway for receiving two or more wires into the chamber. A cover is configured for rotatable coupling to the housing and at least partially enclosing the chamber. A conductive engagement member is coupled to the cover and is rotatable within the chamber upon rotation of the cover. The conductive member includes a fracturing portion that is configured to fracture a portion of any insulated covering on each wire and complete an electrical contact between the conductors of the two or more wires upon rotation of the cover.

Figure 11:
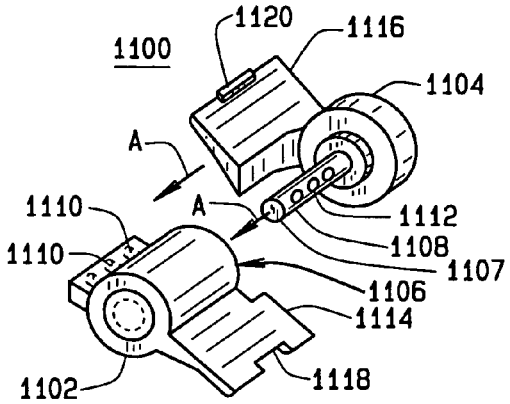
FIG. 11 is perspective view of a disassembled connector according to a third embodiment of the invention.
Figure 12A:
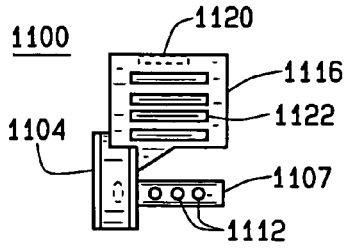
FIGS. 12A & 12B are second perspective views of the connector of FIG. 11.
Figure 12B:
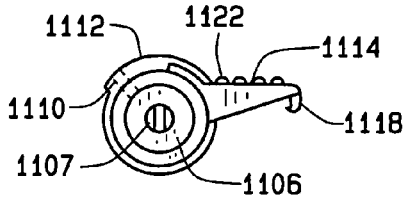

Referring now to FIGS. 11 and 12A and 12B, one such implementation of an electrical connector is illustrated in a partially disassembled form. As shown, a connector 1100 includes a housing 1102 and a cover 1104. The cover 1104 is configured for rotatable coupling to the housing 1102. The housing 1102 includes and defines a chamber 1106. While not illustrated in FIG. 12B, some embodiments can include one or more walls or other structures or features within the chamber 1106 that can be configured to facilitate fracturing. A conductive engagement member 1107 is coupled to the cover 1104 and has an engagement member body 1108 that is dimensioned and configured for insertion and rotation within the chamber 1106 when the cover 1104 is coupled to the housing 1102 as indicated by the assembly directional arrows A. The housing 1102 includes one or more wire receiving passageways 1110 that are open on the exterior surface of the housing 1102 and connect with the chamber 1106. The wire receiving passageways 1110 are dimensioned to receive one or more wires to be electrically coupled by the connector 1100. The engagement member 1107 can also include one or more wire receiving passageways 1112. In some embodiments, the number of engagement member wire receiving passageways 1112 equals and are aligned with the housing wire receiving passageways 1110 when the cover 1104 is coupled to the housing 1102 prior to rotation, e.g., in an un-rotated state.

The engagement member 1107 includes one or more conductive portions for providing electrical conductivity between two or more wires 602. In some embodiments the engagement member 1107 is a single conductive component made of an electrically conductive material as discussed above. In other embodiments, the engagement member 1107 can include two or more electrically isolated segments for electrically coupling two or more electrical circuits. The engagement member body 1108 is shown as being a hollow cylinder or tube, by way of example. However, the engagement member body 1108 can be of any shape or form, so long as configured to fracture a portion of any insulated covering on each wire and complete electrical contact between the conductors of each wire.

As shown in FIG. 11, the housing 1102 can also include a housing lever 1114 and/or the cover can include a cover lever 1116. When one or both housing lever 1114 and cover lever 1116 are provided, they can provide a user of the connector 1100 with portions that enable the user to add leverage to rotate the cover 1104 and the coupled engagement member 1107 relative to the housing 1102 and the housing wire receiving passageways 1110 containing wires (not shown). The housing lever 1114 and the cover lever 1116 can include interlocking engagement members 1118 and 1120 such as tabs or clips, by way of example, that lock together following rotation of the cover 1104 and/or the housing 1102 by the user. In other embodiments, the interlocking engagement members 1118 and 1120 can be included on the housing 1102 and the cover 1104 and not on the levers 1114 and 1116. The levers 1114 and 1116 can be configured with features such as ridges 1122 to add friction against the user's fingers, such as the thumb and pointer fingers, to provide for a quick and easy rotation of the housing 1102 and cover 1104 to engage the connector 1100. The wire receiving passageways 1110 and 1112, the engagement member 1107 and the chamber 1106 are dimensioned and configured such that the engagement member 1107 fractures a portion of any insulating covering or material on each wire inserted and received by the connector 1100 and establishes electrical contact with the conductors of each wire during and following the rotation of the housing 1102 and/or the cover 1104.

Figure 13A:
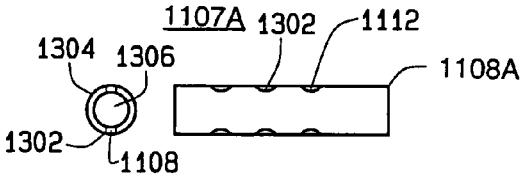
FIGS. 13A, 13B and 13C are side and end views of three embodiments of the conductive member according to the third embodiment of the invention as shown in FIG. 11.
Figure 13B:
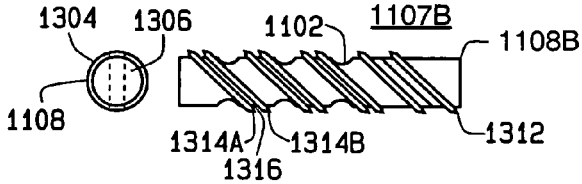
Figure 13C:
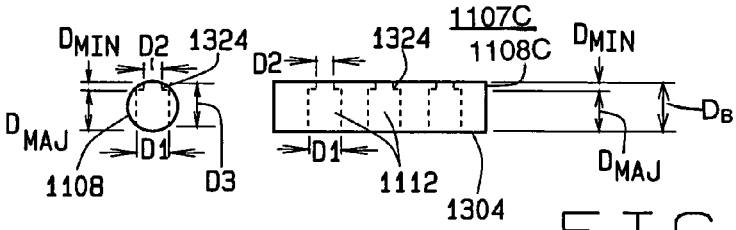

As noted above, the engagement member body 1108 can be implemented in various sizes and arrangements. Three exemplary embodiments of engagement members 1107A, 1107B, and 1107C are illustrated in FIGS. 13A, 13B and 13C, as 1108A, 1108B, and 1108C, respectively. In FIG. 13A, the engagement member 1107A is similar to that illustrated in FIG. 11 as engagement member 1107. The engagement member 1107A includes the engagement member body 1108A that is a cylindrical tube composed of a conductive material such as metal or ceramic. The engagement member body 1108A includes an outer surface 1304 and a hollow inner chamber 1306. The wire receiving passageways 1112 are formed or drilled into one or both opposite portions of the cylindrical tube. In this embodiment, the cylindrical tube engagement member body 1108A and the area around each wire receiving passageway 1112 forms a sharp edge 1302 for fracturing the insulated covering of wires inserted into each wire receiving passageway 1112 during rotation.

FIG. 13B illustrates another exemplary engagement member 1107B having a body 1108B that is a cylindrical tube. However, in this embodiment the outer surface 1304 of the engagement member body 1108B includes fracturing members 1312. The fracturing members 1312 in this example are a series of sharp peaks 1314A and 1314B, separated by a valley 1316. Each peak 1314 provides a sharp edge to fracture the insulated covering of a wire received within the wire receiving passageways 1112. The fracturing members 1312 can surround the outer surface 1304 of the engagement member body 1108B or can be only on portions thereof, and are configured to fracture the wire insulation upon rotation. As shown, the fracturing members 1312 can be in the form of connected threads, similar to the threads of the screw or bolt, or can be ridges or unconnected circular peaks 1314 and valleys 1316.

In the engagement member 1107C of FIG. 13C, an engagement member body 1108C is a solid cylinder having a plurality of wire receiving passageways 1112 formed within the engagement member body 1108C across the diameter $D_B$ of the body 1108C. The wire receiving passageways 1112 can be molded or drilled into the body 1108C. Each wire receiving passageway 1112 has at least two diameters D1 and D2. The majority through-length $D_{MAJ}$ of each wire receiving passageway 1112 has diameter D1 that is greater than the diameter D2. Each wire receiving passageway 1112 of engagement member body 1108C has a minority through-length $D_{MIN}$ proximate to at least one outer surface 1304 of the body 1322 to form a fracturing edge 1324 that is defined by the difference in diameters D1 and D2 and the outer surface 1304. By configuring the minority through-length $D_{MIN}$ having the smaller diameter D2 as compared to the total diameter of the body $D_B$, the fracturing edge 1324 can be configured to be sharp for fracturing the insulated covering the wire upon rotation of the engagement member 1107C.

Other configurations and embodiments of the engagement member 1107 and engagement member body 1108 are also possible, though not illustrated in FIGS. 13A, 13B, or 13C. Additionally, as noted above each engagement member 1107 can be segmented to have two or more electrically separate segments to provide for electrically coupling a plurality of separate electrical circuits with connector 1100.

Figure 14A:
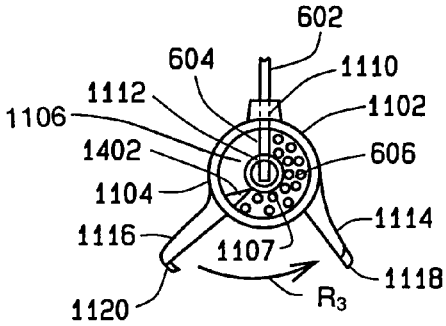
FIGS. 14A and 14B are end views of one implementation of the third exemplary embodiment of FIG. 11 illustrating the before and after coupling of a wire.
Figure 14B:
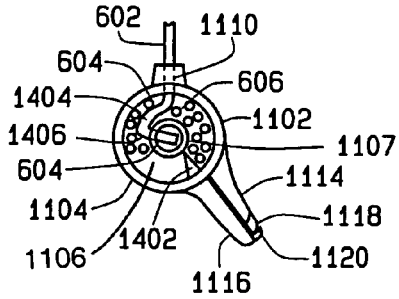

One embodiment of an operation of the connector 1100 is illustrated in the end views of FIGS. 14A and 14B. FIG. 14A illustrates the connector 1100 having wires inserted into the connector by a user and FIG. 14B illustrates the connector following rotation of the cover 1104 relative to the housing 1102 by the user. As shown in FIGS. 14A and 14B, the connector 1100 is assembled with the cover 1104 rotatably coupled to the housing 1102. In this exemplary embodiment, the cover 1104 has a cover lever 1116 and the housing 1102 has a housing lever 1114. The sealing material 606 is positioned, at least partially, within the chamber 1106. The cover 1104 also includes a wiper blade 1402 that extends or protrudes into the chamber 1106 for distributing the sealing material 606 during rotation of the cover 1104. While not illustrated in FIG. 14A, some embodiments can include one or more walls or other structures or features within the chamber 106 that can be configured to facilitate fracturing.

During the initial operation by the user, one or more wires 602 are inserted into the housing wire receiving passageways 1110 and the chamber 1106. The wire ends 604 enter the chamber and are received by an engagement member wire receiving passageway 1112. The wire ends 604 are shown as being partially within the wire receiving passageways 1112, but in other embodiments, the wire ends 604 can extend through the wire receiving passageways 1112 in back into the chamber 1106.

After the wires are inserted into the connector 1100, the user rotates the cover 1104 relative to the housing 1102 as shown by arrow $R_3$ by utilizing the cover lever 1116 and housing lever 1114. Typically, this is by simple operation of two fingers placed on levers 1114 and 1116. During the rotation operation of $R_2$, the wire ends 604 are secured within the engagement member wire receiving passageways 1112 and frictionally urged between the inner surface of the chamber 1106 and the engagement member 1107. The wire 602 is compressed and forced between the inner surfaces of the chamber 1106 and the engagement member 1107 and to have one or more changes of directions, such as the imparting of angles or bends within the length of wire 602 within the chamber 1106. These changes of directions restrict the linear movement or travel of the wire 602. By so restricting the linear movement, the wire end 604 is urged against the engagement member 1107 to fracture, at least a portion of, any insulated covering on the wire end 604 to form a fractured portion 1404. The urging and rotational movement of the engagement member 1107 can fracture the portion 1404 thereby exposing the conductor within the wire 602. The engagement member 1107 can also cut and/or strip a portion of the insulated covering on the wire end 604 in some embodiments. Additionally, the engagement member 1107 having at least portions of conductive material, contacts the exposed conductor on a contact portion 1406 of the exposed or fractured portion 1404 thereby completing an electrical connection between the engagement member 1107 and the conductor of the wire 602. When a plurality of wires 602 is inserted into the connector 1100, the engagement member 1107 provides the electrical connectivity between the wires 602.

As shown in FIG. 14A, the wiper blade 1402 captures and distributes at least a portion of the sealing material 606 within the chamber 1106. This can include distributing the sealing material 606 around the wire ends 604, the fractured portion 1404, the contact portion 1406 and/or the wire receiving passageways 1110. Additionally, the interlocking engagement members 1118 and 1120 engage to lock the cover 1104 relative to the housing 1102 thereby maintaining the engagement member 1107 in electrical contact with each contacted portion 1406 of each wire 602. The interlocking engagement members 1118 and 1120 can also be configured to enable the user to release their interlocking to reverse the rotation to enable the withdrawal or removal of the wires 602 from the connector 1100.

When describing elements or features of the present invention or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the invention. Accordingly, all matter contained in the above description or shown in the accompanying drawings should be interpreted as illustrative and not in a limiting sense.

What is claimed is:

1. An electrical connector comprising:

a housing having a chamber;

at least one wire receiving passageway for receiving two or more wires into the chamber; and an engagement member rotatable within the chamber, the engagement member being configured to deform at least one of the wires received into the chamber and fracture a portion of any insulated covering on each wire and complete electrical contact between conductors of the two or more wires upon rotation of the engagement member;

wherein the chamber and the engagement member are dimensioned to enable the fracturing to include stripping the portion of the any insulated covering of the each wire to expose a conductor of each wire.

2. The electrical connector of claim 1 wherein the housing includes a plurality of wire receiving passageways each configured to receive at least one end of one of the wires.

3. The electrical connector of claim 1 wherein the engagement member includes a conductive portion for completing the electrical contact between the conductors.

4. The electrical connector of claim 3 wherein the chamber and engagement member are configured to retain the contact of the conductive portion with the conductors after completion of the rotation.

5. The electrical connector of claim 1 wherein the housing and engagement member are configured to impart at least one directional change to the wires during rotation.

6. The electrical connector of claim 1 wherein the engagement member includes a fracturing member.

7. The electrical connector of claim 6 wherein the engagement member includes a conducting portion, and wherein the fracturing member is configured to strip at least the portion of the any insulated covering and expose the portion of the conductor for contact by the conducting portion of the engagement member.

8. The electrical connector of claim 1 wherein the engagement member is configured to fracture the any insulated covering and complete the electrical contact between the two or more wires with less than a 90 degree rotation of the engagement member.

9. The electrical connector of claim 1, further comprising a cover configured for coupling to the housing and at least partially enclosing the chamber.

10. The electrical connector of claim 9 wherein the engagement member includes a conductive portion and is attached to the cover and the cover is rotatably coupled to the housing, said engagement member stripping the portion of the any insulated covering and said conductive portion of the engagement member contacting the conductor in response to rotating the cover.

11. The electrical connector of claim 10 wherein the cover includes a lever for rotating the cover relative to the housing and the housing includes a lever for stabilizing the housing during rotation of the cover.

12. The electrical connector of claim 11 wherein the cover lever and the housing lever include locking engagement members for fixedly coupling the cover lever to the housing lever upon rotation of the cover.

13. The electrical connector of claim 9 wherein the cover and the housing include interlocking engagement members for fixedly coupling the cover to the housing upon rotation of the cover.

14. The electrical connector of claim 1, further comprising a moisture resistant encapsulant within the chamber.

15. The electrical connector of claim 14 wherein the moisture resistant encapsulant is positioned within the chamber to encapsulate at least a portion of the conductors and at least partially restricting the introduction of moisture about the conductors and at least partially sealing the at least one wire receiving passageway upon rotation of the engagement member.

16. The electrical connector of claim 14, further comprising a wiper blade configured to distribute the moisture resistant encapsulant within the chamber upon rotation of the engagement member.

17. The electrical connector of claim 1 wherein the engagement member is a tube having sidewalls and a plurality of engagement member wire receiving passageways on at least one of the sidewalls, said engagement member having a cutting member along the at least one of the sidewalls for fracturing the any insulated covering of the wires received within the engagement member wire receiving passageways.

18. The electrical connector of claim 17 wherein each of the engagement member wire receiving passageways has a first diameter and a second diameter with said second diameter being less than the first diameter, said cutting member including a sidewalls proximate to the second diameter of the engagement member wire receiving passageways.

19. The electrical connector of claim 1 wherein the engagement member includes at least one sharp thread on an external surface for fracturing the any insulated covering of each of the wires.

20. The electrical connector of claim 1 wherein the engagement member includes a user rotational element for rotating the engagement member, the user rotational element being selected from the group consisting of a handle, a knob, a screw head, threads, notch, tab, and an Allen head.

21. The electrical connector of claim 1, further comprising a conductive member for contacting each of the conductors, wherein said conductive member includes a cutting portion and said engagement member is configured to urge each wire into contact with the cutting portion upon rotation of the engagement member for cutting the any insulated covering of the wires and contacting the conductor within.

22. The electrical connector of claim 21 wherein the conductive member includes an at least partly threaded cylinder with the threads being the cutting portion.

23. The electrical connector of claim 1 wherein said engagement member completes a plurality of separate electrical contacts between the conductors of the two or more wires upon rotation of the engagement member.

24. The electrical connector of claim 1 wherein the engagement member includes a conductive engagement member comprising a metal tube having sidewalls, a plurality of engagement member wire receiving passageways on at least one of the sidewalls, and a cutting member along the at least one of the sidewalls for fracturing the any insulated covering of the wires received within the engagement member wire receiving passageways.

25. The electrical connector of claim 1 wherein the engagement member includes a conductive engagement member comprising an at least partly threaded cylinder with threads being configured to fracture at least the portion of the any insulated covering.

26. The electrical connector of claim 1 wherein the engagement member is configured to wrap the each wire about at least part of the engagement member upon rotation of the engagement member.

27. The electrical connector of claim 1 wherein the engagement member is configured to retain in the connector the two or more wires received into the chamber.

28. An electrical connector comprising:

a housing having a chamber and at least one wire receiving passageway for receiving two or more wires into the chamber;

a cover configured for rotatable coupling to the housing and at least partially enclosing the chamber; and a conductive engagement member coupled to the cover and rotatable within the chamber upon rotation of the cover, the conductive engagement member being configured to deform at least one of the wires received into the chamber upon rotation of the cover and fracture a portion of any insulated covering on each wire and complete an electrical contact between conductors of the two or more wires upon rotation of the cover;

wherein the conductive engagement member is configured to strip at least the portion of the any insulated covering of each wire and expose a portion of the conductor of the each wire for contact by the conductive engagement member.

29. The electrical connector of claim 28 wherein the housing and conductive engagement member are configured to impart at least one directional change to the two or more wires during rotation and fracture the any insulated covering and complete the electrical contact between the conductors of the two or more wires with less than a 90 degree rotation of the conductive engagement member.

30. The electrical connector of claim 28 wherein the cover includes a lever for rotating the cover relative to the housing and the housing includes a lever for stabilizing the housing during rotation of the cover.

31. The electrical connector of claim 28 wherein the cover and the housing include interlocking engagement members for coupling the cover to the housing upon rotation of the cover.

32. The electrical connector of claim 28, further comprising:

a moisture resistant encapsulant positioned within the chamber to encapsulate at least a portion of the conductors and at least partially restricting the introduction of moisture about the conductors and at least partially sealing the at least one wire receiving passageway upon rotation of the cover; and a wiper blade configured to distribute the moisture resistant encapsulant within the chamber upon rotation of the cover.

33. An electrical connector comprising:

a housing having a chamber and a plurality of wire receiving passageways for receiving two or more wires into the chamber; and a conductive engagement member rotatable within the chamber and including a plurality of engagement member wire receiving passageways for receiving ends of the two or more wires, said conductive engagement member being configured to deform at least one of the wires received into the chamber upon rotation of the conductive engagement member, said conductive engagement member having a fracturing portion configured to fracture a portion of any insulated covering on each wire and complete an electrical contact between conductors of the two or more wires upon rotation of the conductive engagement member within the housings;

wherein fracturing the portion of the any insulated covering on the each wire includes stripping the portion of the any insulated covering of the each wire to expose the conductor of the each wire for contact by the conductive engagement member.

34. The electrical connector of claim 33 wherein the fracturing portion is configured to fracture the portion of the any insulated covering with less than a 90 degree rotation of the conductive engagement member within the housing.

35. An electrical connector comprising:

a housing having a chamber and at least one wire receiving passageway for receiving two or more wires into the chamber;

a cover configured for rotatable coupling to the housing and at least partially enclosing the chamber;

a conductive engagement member coupled to the cover and rotatable within the chamber upon rotation of the cover, the conductive engagement member being configured to fracture a portion of any insulated covering on each wire and complete an electrical contact between conductors of the two or more wires upon rotation of the cover;

the cover including a lever extending generally away from the cover and capable of rotating the cover in a first direction relative to the housing, and the housing including a lever extending generally away from the housing and capable of rotating the housing in a second direction relative to the cover.

36. The electrical connector of claim 35 wherein the housing and conductive engagement member are configured to impart at least one directional change to the each wire during rotation of the conductive engagement member for helping to retain said wire in the connector.

37. The electrical connector of claim 35 wherein the lever of the cover includes an arm extending generally away from the cover, and wherein the lever of the housing includes an arm extending generally away from the housing.

38. The electrical connector of claim 35 wherein the lever of the cover and the lever of the housing both rotate to complete electrical contact between the conductors of the two or more wires.

* * * * *